US005298680A

United States Patent [19]

Kenny

[11] Patent Number: 5,298,680

[45] Date of Patent: Mar. 29, 1994

[54] DUAL TWISTED PAIRS OVER SINGLE JACKET

[76] Inventor: Robert D. Kenny, 4260 C Oxford Riley Rd., Oxford, Ohio 45056

[21] Appl. No.: 926,104

[22] Filed: Aug. 7, 1992

[51] Int. Cl.[5] ..... H01B 11/06

[52] U.S. Cl. ..... 174/36; 174/34

[58] Field of Search ..... 174/36, 33, 34

[56] References Cited

U.S. PATENT DOCUMENTS

| | | | |
|---|---|---|---|
| 1,083,258 | 12/1913 | Kitsee | 174/36 |
| 1,277,025 | 8/1918 | Anderegg et al. | 174/34 |
| 2,081,427 | 5/1937 | Firth et al. | 174/34 |
| 3,382,314 | 5/1968 | Nordblad | 174/34 |
| 3,821,465 | 6/1974 | Karlstedt | 174/113 R |
| 3,894,172 | 7/1975 | Jachimowicz et al. | 174/34 |
| 4,697,051 | 9/1987 | Beggs et al. | 174/34 |
| 4,873,393 | 10/1989 | Friesen et al. | 174/34 |
| 5,149,915 | 9/1992 | Brunker et al. | 174/36 |

*Primary Examiner*—Morris H. Nimmo

*Attorney, Agent, or Firm*—Laff, Whitesel, Conte & Saret

[57] ABSTRACT

An electronic data transmission cable with twisted pairs (16) and (18) twisted into group (32). To reduce electro magnetic interference between adjacent insulated conductors (12) twisted pair such as (16) and (18) are combined into group (32). Other groups (34) and (36) may be pulled in parallel or may be twisted together prior to forming cable (30).

18 Claims, 2 Drawing Sheets

DUAL TWISTED PAIRS OVER SINGLE JACKET

BACKGROUND OF THE INVENTION

This application relates in general to electronic cables utilizing twisted pair technology for the transmission of balanced or unbalanced signals.

A twisted pair arrangement consists of two insulated conductors twisted about each other to form a two conductor group. When more than one twisted pair group is bunched or cabled together, it is referred to as a multi-pair cable. A problem encountered when using a multi-paired cable is that data transmitted on one pair can often interfere with the transmission of data on another pair within the multi-pair cable. This is due to the fact that all insulated conductors or pairs carrying data in the form of current will radiate an electric and magnetic field. This is commonly referred to as electromagnetic noise interference, or EMI. The further away one wire is from another wire generating this interference, the less susceptibility there is to its effects.

One prior art method of distancing elements, in this case twisted pairs, is discussed in U.S. Pat. No. 4,873,393, assigned to AT&T. In '393 individual pairs have different nonsequentional laylengths. Laylength is a term referring to the axial distance required for one conductor to complete one revolution about the axis of another conductor. It is known that when adjacent twisted pairs employ the same twist frequency they tend to nest into each other, making each pair more susceptible to the other's emissions. By varying the laylengths, this nesting effect is reduced. However, problems still arise with this solution. An example illustrating the problem is realized when a twisted pair, whether varied in twist frequency or not, can have as many as six adjacent pairs surrounding it. Therefore, one pair can have up to six noise sources directly surrounding it.

SUMMARY OF THE INVENTION

The present invention is a cable for electronic transmission of data comprised of twisting together a first and second pair to form a first group, and twisting together a third and fourth pair to form a second group. In another embodiment, the first and second groups are twisted together forming an overall multi-group cable. More than two groups may also be used.

Using this technique, the maximum adjacent pair count is one, greatly reducing any one pair's susceptibility to interfere when compared with those cables whose pairs have multiple adjacent elements. By limiting the number of adjacent pairs to one, hence limiting noise coupling, subsequent data transmission over the pairs within said cable is improved. Additionally, by using the dual twisted pair concept more air is introduced into the cable, lowering the overall dielectric properties of the cable. Air is the lowest dielectric next to a vacuum. This will further lower the cables attenuation which is a favorable result. All of these beneficial effects can also be obtained by pulling the dual twisted pair groups in parallel with each other to form a multi-group cable rather than twisting the groups together.

DETAILED DESCRIPTION OF THE DRAWINGS

Figure 1:
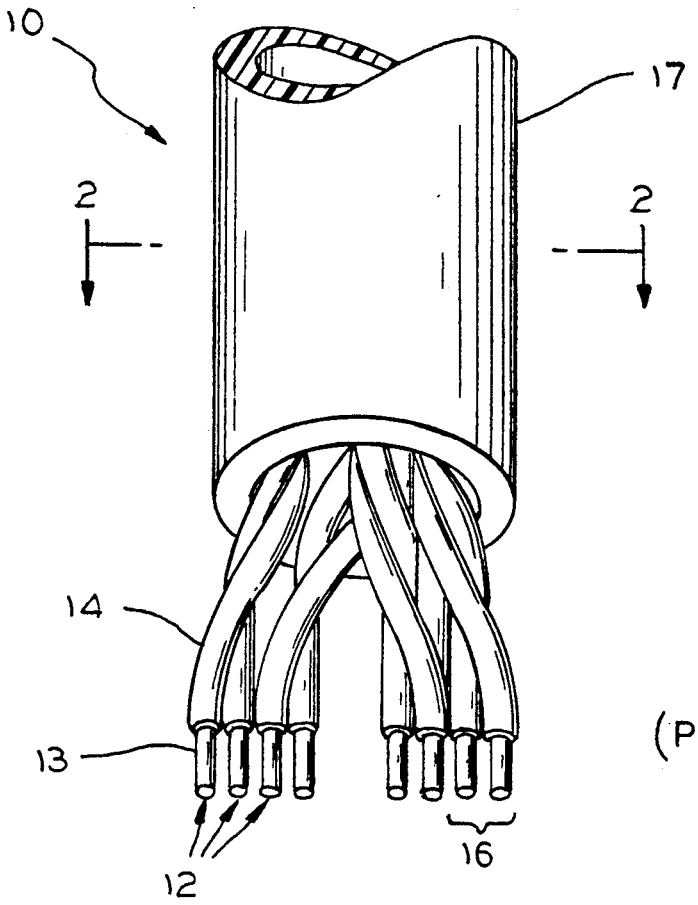
FIG. 1 (PRIOR ART)
FIG. 1 is a perspective view of a twisted pair cable as known in the prior art.
Figure 2:
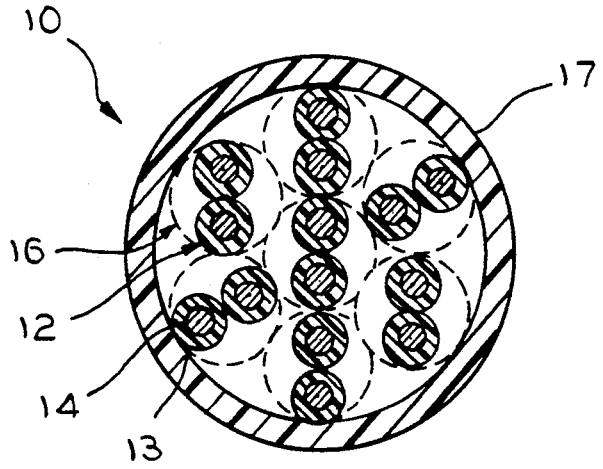
FIG. 2 (PRIOR ART)
FIG. 2 is a cross sectional view along lines 2—2 of the prior art cable shown in FIG. 1.

Referring now to FIG. 1 there is shown a multi-pair data transmission cable designated generally by the numeral 10. Individual conductors 12 are comprised of conducting material 13 and insulating material 14. Conductors 12 are twisted together to form twisted pairs 16. Pairs 16 are enclosed in an insulating jacket 17 to form multi-pair cable 10. Shown in a cross sectional view in FIG. 2, it is seen that many of the individual conductors lie adjacent to other conductors in different pairs, causing interference as discussed above.

Figure 3:
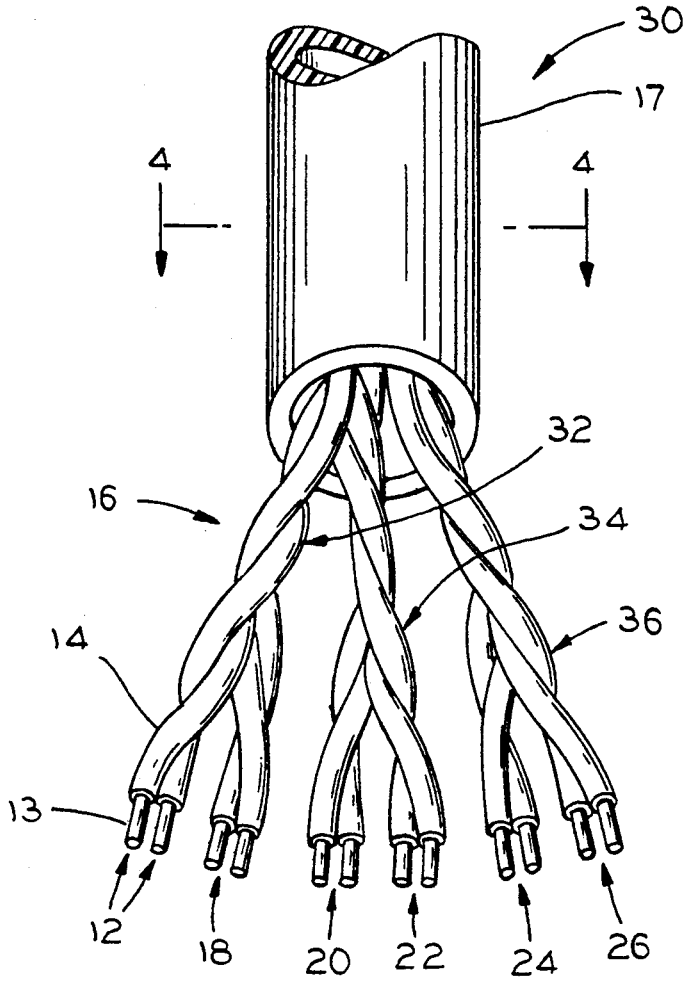
FIG. 3 is a perspective view of a twisted pair cable according to the present invention.
Figure 4:
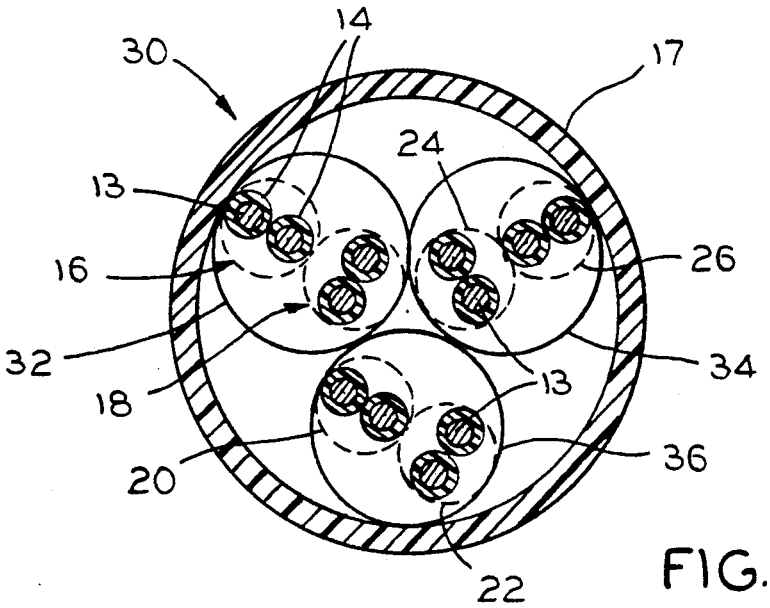
FIG. 4 is a cross sectional view of the cable shown in FIG. 3 along lines 4—4.

FIG. 3 shows a multi-media cable 3 according to the present invention. Insulated conductors 12 are the same as conductors in prior art and consist of a conductor 13 in an insulated jacket 14. The conductors 12 are twisted together to form a twisted pair 16. A second twisted pair 18 is combined with first twisted pair 16 to form a twisted pair first group 32. In a similar manner, twisted pair 20 and third twisted pair 22 are twisted together to form a second group 34. Likewise, twisted pair 24 and 26 are twisted together to form twisted pair group 36. These are encased in a jacket 16.

In the example shown in FIG. 3, first twisted pair 16 is twisted counter clockwise, and twisted pair 18 is twisted clockwise. These are joined together to form first group 32 by twisting counter clockwise. It is not necessary for the purpose of this invention that twisted pairs 16 and 18 be twisted in opposite directions, but this further reduces EMI.

Second group 34 is also comprised of two oppositely twisted pairs 20 and 22. However, the group 34 is twisted in a clockwise direction. It is not necessary for the purpose of this invention that groups 32 and 34 be twisted in opposite directions, but it preferable due to reduction in EMI.

While this invention has been illustrated and described in accordance with a preferred embodiment, it is recognized that variations and changes may b made therein without departing from the invention as set forth in the claims.

I claim:

1. A cable suitable for balanced mode transmission with relatively low crosstalk, said cable comprising:

a first set of conductors twisted to form a first pair;

a second set of conductors twisted to form a second pair, wherein said second pair is twisted with said first pair to form a first dual twisted pair group;

a third set of conductors twisted to form a third pair; and a fourth set of conductors twisted to form a fourth pair, wherein said fourth pair is twisted with said third pair forming a second dual twisted pair group, wherein said first group and said second group are twisted together.

2. A cable as in claim 1 wherein said third and fourth pairs forming said second group are twisted with each other in a direction opposite to the twist direction of said first and second pairs forming said first group.

3. A cable as in claim 1 wherein said first group and said second group are surrounded by a metallic shield.

4. A cable as in claim 1 wherein said cable comprises more than four groups.

5. A cable as in claim 1 wherein a sheath of plastic encloses said cable.

6. A cable as in claim 1 wherein a sheath of fluorocopolymer material encloses said cable.

7. A cable as in claim 1 wherein a sheath of fluorocopolymer insulation encloses said cable.

8. A cable as in claim 1 wherein a laylength of said first pair is different from a laylength of said third pair.

9. A cable as in claim 1 wherein a laylength of said first group is different from a laylength of said second group.

10. A cable suitable for balanced mode transmission with relatively low crosstalk, said cable comprising:

a first set of conductors twisted to form a first pair;

a second set of conductors twisted to form a second pair, wherein said second pair is twisted with said first pair to form a first dual twisted pair group;

a third set of conductors twisted to form a third pair;

a fourth set of conductors twisted to form a fourth pair, wherein said fourth pair is twisted with said third pair forming a second dual twisted pair group; and a fifth set of conductors twisted to form a fifth pair; and a sixth set of conductors twisted to form a sixth pair, wherein said sixth pair is twisted with said fifth pair forming a third dual twisted pair group, wherein said first, second, and third groups are twisted to form a cable.

11. A cable as in claim 10 wherein said first group and said second group are surrounded by a metallic shield.

12. A cable as in claim 10 wherein said third and fourth pairs forming said second group are twisted with each other in a direction opposite to the twist direction of said first and second pairs forming said first group.

13. A cable as in claim 10 wherein said cable comprises more than four groups.

14. A cable as in claim 10 wherein a sheath of plastic encloses said cable.

15. A cable as in claim 10 wherein a sheath of fluorocopolymer material encloses said cable.

16. A cable as in claim 10 wherein a sheath of fluorocopolymer insulation encloses said cable.

17. A cable as in claim 10 wherein a laylength of said first pair is different from a laylength of said second pair.

18. A cable as in claim 10 wherein a laylength of said first group is different from a laylength of said second group.

* * * * *

UNITED STATES PATENT AND TRADEMARK OFFICE

CERTIFICATE OF CORRECTION

PATENT NO. : 5,298,680

DATED : March 29, 1994

INVENTOR(S) : Robert D. Kenny

It is certified that error appears in the above-indentified patent and that said Letters Patent is hereby corrected as shown below:

On the title page, insert the following information:

[73] Assignee: Belden Wire & Cable Company, Richmond, Ind.

Signed and Sealed this

Fifteenth Day of August, 1995

Bruce Lehman

*Attest:*

BRUCE LEHMAN

*Attesting Officer*

*Commissioner of Patents and Trademarks*